US005087195A

United States Patent [19]

Nakanishi et al.

[11] Patent Number: 5,087,195

[45] Date of Patent: Feb. 11, 1992

[54] COMBUSTION CYLINDER STRUCTURE FOR OIL BURNER

[75] Inventors: Yutaka Nakanishi; Toru Nakagaito, both of Aichi, Japan

[73] Assignee: Toyotomi Kogyo Co., Ltd., Japan

[21] Appl. No.: 427,405

[22] Filed: Oct. 27, 1989

[30] Foreign Application Priority Data

Oct. 29, 1988 [JP] Japan ..... 63-274274
Nov. 5, 1988 [JP] Japan ..... 63-279871

[51] Int. Cl.[5] ..... F23D 3/04

[52] U.S. Cl. ..... 431/309; 431/311; 431/314; 126/96

[58] Field of Search ..... 431/300, 302, 303, 310, 431/311-312, 313, 314, 309, 198, 201; 126/96, 97

[56] References Cited

U.S. PATENT DOCUMENTS

| | | | |
|---|---|---|---|
| 1,290,856 | 1/1919 | White et al. | 431/201 |
| 1,428,212 | 9/1922 | Brennan | 431/201 |
| 2,060,317 | 11/1936 | Hoffman | 431/201 X |
| 4,390,003 | 6/1983 | Nakamura et al. | 431/201 X |
| 4,484,886 | 11/1984 | Nakamura et al. | 431/309 X |
| 4,569,562 | 2/1986 | Nakamura et al. | 431/201 |
| 4,608,010 | 8/1986 | Nakamura et al. | 431/88 |
| 4,790,746 | 12/1988 | Uno et al. | 431/302 |

FOREIGN PATENT DOCUMENTS

| | | | |
|---|---|---|---|
| 32101 | 5/1976 | Japan . | |
| 0112919 | 9/1980 | Japan | 431/201 |
| 55083 | 6/1982 | Japan . | |
| 0165511 | 7/1986 | Japan | 431/302 |
| 0240015 | 10/1986 | Japan | 431/309 |

*Primary Examiner*—Carl D. Price
*Attorney, Agent, or Firm*—Pollock, Vande Sande & Priddy

[57] ABSTRACT

A combustion cylinder structure for an oil burner capable of stably carrying out minimum combustion as well as controlling the combustion operation over a wide range. The structure is so constructed that a lower heat-impermeable cylinder of an outermost cylinder construction of a multi-cylinder combustion assembly is provided at the upper end thereof with an inward collar, which is provided at the inner end thereof a cylindrical section for rectifying air introduced through a gap between the cylindrical section and an outer cylindrical member to guide it along the cylindrical member. Also, the collar is provided with through-holes, which are arranged in the circumferential direction to guide air along a heat-impermeable cylinder arranged on the heat-impermeable cylinder, resulting in preventing the generation of a turbulent flow between the outer cylindrical member and the heat-permeable cylinder.

10 Claims, 4 Drawing Sheets

COMBUSTION CYLINDER STRUCTURE FOR OIL BURNER

BACKGROUND OF THE INVENTION

This invention relates to a combustion cylinder structure for an oil burner, and more particularly to a combustion cylinder structure for an oil burner which is adapted to discharge heat rays emitted from red-heated inner and outer combustion cylindrical members through a heat-permeable cylinder to the exterior.

Conventionally, there is known a combustion cylinder structure for an oil burner which is constructed in such a manner that a heat-permeable cylinder is arranged outside a double-cylinder combustion means including an inner cylindrical member and an outer cylindrical member each formed with a plurality of small through-holes, so that fuel oil vaporized from a wick is thermally decomposed to produce combustible gas in a first space between both cylindrical members, which is then burned in the combustion means while rising in the first space to red-heat both cylindrical members, resulting in heat rays being radiated therefrom through the heat-permeable cylinder to the exterior of the oil burner for heating. The combustion of the vaporized fuel oil is carried out near the through-holes of the cylindrical members using combustion air supplied through the through-holes of the cylindrical members to the first space. In the so-constructed combustion cylinder structure, it is carried out to vary a pressure balance in order to causes a part of the combustible gas to be discharged, together with a part of flame formed in the first space, from the first space via the through-holes of the outer cylindrical member to the outside of the outer cylindrical member or a second space between the outer cylindrical member and the heat-permeable cylinder. In this instance, where the through-holes of the outer cylindrical member are formed into a small diameter, the flame is cooled by the outer cylindrical member at the time when it passes through the through-holes of the outer cylindrical member, resulting in being extinguished. This leads to the generation of incomplete combustion gas.

In order to avoid such a problem, it is proposed that the through-holes of the outer cylindrical member are formed into a larger diameter so as to facilitate the migration or leakage of the flame and gas from the first space to the second space. Such construction is considered to eliminate the deterioration of red-heating of the outer cylindrical member which is caused due to the cooling of the outer surface of the outer cylindrical member by combustion air rising along the outer surface, because a part of the combustible gas leaking to the outside of the outer cylindrical member is burned on the outer surface of the outer cylindrical member to surround the outer surface with a flame produced by the combustion.

Unfortunately, actually it is highly difficult or substantially impossible to control the amount of the combustible gas leaking to the outside of the outer cylindrical member. For example, when the combustible gas leaks in an amount which cause the flame to be lifted out of the through-holes of the outer cylindrical member, the flame is cooled by combustion air of a low temperature, resulting in being partially extinguished to lead to the generation of incomplete combustion gas. As an approach to the problem, it would be considered to burn the so-generated incomplete combustion gas at the upper section of the first space between the inner cylindrical member and the outer cylindrical member.

However, combustion gas containing the so-generated incomplete gas is diffused throughout the second space between the outer cylindrical member and the heat-permeable cylinder, therefore, the conventional combustion cylinder structure causes at least a part of the incomplete combustion gas to be exhausted to the exterior of the oil burner without being subjected to complete combustion. This occurs particularly when the wick is lowered for a small amount of combustion, because the combustion at this time is substantially carried out at a lower section of the first space.

In order to eliminate such a disadvantage, in the conventional combustion cylinder structure, it is proposed to form the lower through-holes of the outer cylindrical member into a smaller diameter and arrange an inward collar of an annular shape on the inner surface of a heat-impermeable cylinder in a manner to inward extend toward the outer cylindrical member to define an annular gap between the collar and the outer cylindrical member, as disclosed in Japanese Patent Publication No. 55083/1982. More particularly, as shown in FIG. 1, a heat-impermeable cylinder 100 on which a heat-permeable cylinder 102 is supported is provided with a collar 104 of an annular shape in a manner to inward extend from the cylinder 102 toward a perforated outer cylindrical member 106 to define a gap 108 between the outer cylindrical member 106 and the collar 104, so that combustion air may be positively supplied to a first space 110 between a perforated inner cylindrical member 112 and the outer cylindrical member 106, resulting in the positive combustion of the combustible gas in the first space 110 when a wick is lowered for a small amount of combustion.

However, such construction of the combustion cylinder structure causes the maximum combustion or heating capacity of the structure to be substantially decreased, because the collar 104 substantially restricts the amount of combustion air supplied to a second space 114 defined between the outer cylindrical member 106 and the heat-permeable cylinder 102 through a space between the heat-impermeable cylinder 100 and the outer cylindrical member 106. In order to avoid such a problem, it would be considered to expand the gap 108. However, this causes a large amount of air to readily rise in the second space 114, so that the amount of air to be supplied to the first space 110 is highly reduced to a degree sufficient to cause incomplete combustion in the first space 110.

Thus, the conventional combustion cylinder construction renders an increase in size or width of the gap 108 substantially impossible. Substitutively, the upper through-holes of the outer cylindrical member 106 are formed into a larger diameter to guide a part of the combustible gas from the first space to the second space 114 for burning it in the upper section of the second space 114, to thereby prevent a reduction in maximum combustion capacity of the structure.

Nevertheless, in the conventional combustion cylinder structure, the above-described construction of the collar 104 causes a part of combustion air supplied through the gap 108 to the second space 114 to whirl above the collar 104 as indicated by arrows in FIG. 1, leading to a turbulent flow, which cooperates with another part of the combustion air rising in the second space 114 to spread or diffuse combustion gas produced on the outer surface of the outer cylindrical member 106 throughout the second space 114, so that the control of combustion in the combustion cylinder structure is restricted to a significant degree.

Also, it is proposed that the conventional combustion cylinder construction is provided with a central cylinder in a manner to be suspended from an annular top plate of the inner cylindrical member to a position of a red-heated section of the double-cylinder combustion means for the purpose of improving the red-heating of the combustion means, as disclosed in Japanese Utility Model Publication No. 32101/1976. The arrangement of such a central cylinder permits air supplied to a gap or space between the inner cylindrical member and the central cylinder to be uniformly supplied via the through-holes of the inner cylindrical member to the first space between the inner cylindrical member and the outer cylindrical member, as well as prevents air upward supplied through the central cylinder to a flame spreading means or re-combustor from adversely affecting the red-heating of the double-cylinder combustion means.

In the combustion cylinder structure of such construction, when the wick is lowered for a small amount of combustion during the combustion operation, the burning of combustible gas produced due to the thermal decomposition of fuel oil vaporized from the wick such as hydrocarbon of a low molecular weight, carbon monoxide and the like is substantially completed in the first space between the inner cylindrical member and the outer cylindrical member. At this time, air supplied from the lower end of the oil burner through its interior to the gap between the central cylinder and the inner cylindrical member is then supplied via the through-holes of the inner cylindrical member to the first space. Accordingly, when the wick is lowered to a degree sufficient to cause the combustion of the combustible gas to be completed in the first space, air upward flowing through the space between the inner cylindrical member and the central cylinder tends to be readily guided via the upper through-holes of the inner cylindrical member to the upper section of the first space, so that air supplied to the lower section of the first space is decreased to a degree sufficient to cause the incomplete combustion of the combustible gas.

SUMMARY OF THE INVENTION

Accordingly, it is an object of the present invention to provide a combustion cylinder structure for an oil burner which is capable of controlling the combustion operation over a wide range.

It is another object of the present invention to provide a combustion cylinder structure for an oil burner which is capable of significantly improving the condition of combustion when a wick is lowered for a small amount of combustion.

It is a further object of the present invention to provide a combustion cylinder structure for an oil burner which is capable of satisfactorily accomplishing a small amount of combustion without any incomplete combustion.

It is still another object of the present invention to provide a combustion cylinder structure for an oil burner which is capable of emitting a sufficient amount of heat rays.

It is yet another object of the present invention to provide a combustion cylinder structure for an oil burner which is capable of ensuring the complete combustion of fuel oil even when a wick is lowered for a small amount of combustion.

It is still a further object of the present invention to provide a combustion cylinder structure for an oil burner which is capable of accomplishing the above-noted objects with a simple construction.

In accordance with the present invention, a combustion cylinder structure for an oil burner is provided. The combustion cylinder construction includes a multi-cylinder combustion means including a perforated inner cylindrical member, a perforated outer cylindrical member arranged outside the inner cylindrical member and an outermost cylinder arranged outside the outer cylindrical member. The outer cylindrical member is formed at the lower portion thereof with a plurality of through-holes of a smaller diameter and at the middle and upper portion thereof with a plurality of through-holes of a larger diameter. The outermost cylinder comprises a heat-impermeable cylinder arranged so as to surround the lower portion of the outer cylindrical member and a heat-permeable cylinder arranged on the heat-impermeable cylinder so as to surround the middle and upper portions of the outer cylindrical member. The combustion cylinder structure also includes a collar provided at the upper portion of the heat-impermeable cylinder so as to inward extend therefrom toward the outer cylindrical member. The heat-permeable cylindrical is put on the collar.

In a preferred embodiment of the present invention, the collar is upward bent at the distal end thereof to form a cylindrical section which is spaced from the outer cylindrical member to define a gap therebetween. Also, the collar is formed at the portion thereof between the cylindrical section and the heat-permeable cylinder with through-holes.

In a preferred embodiment of the present invention, the through-holes of the collar are circumferentially arranged.

In a preferred embodiment of the present invention, the through-holes of the collar are arranged at substantially equal intervals.

The combustion cylinder structure may further includes a central cylinder arranged in the inner cylindrical member in a manner to be suspended from an annular top member of the inner cylindrical plate and positioned opposite to the red-heated section of the inner cylindrical member. The central cylinder is formed at the upper portion thereof with through-holes. The structure also includes a partition plate arranged between the lower end of the central cylinder and the inner cylindrical member so as to restrict the introduction of air through a gap between the lower end of the central cylinder and the inner cylindrical member into a space therebetween and a flame spreading device including a flame spreading cylinder communicating through the top plate with the central cylinder. The top plate of the inner cylindrical member is formed with through-holes.

The central cylinder may be formed with a step which divides the central cylinder into an upper section of a smaller diameter and a lower section of a larger diameter.

The step may be arranged at substantially the same level as the upper end of a flame produced when a wick is lowered for a minimum amount of combustion.

The through-holes of the top plate are preferably formed at the portion of the top plate positioned above the step.

The partition plate may be arranged to prevent air from being introduced through the gap into the space between the central cylinder and the inner cylindrical member into the space therebetween. Alternatively, the partition plate may be arranged so as to permit a slight amount of air to be supplied therethrough into the space between the central cylinder and the inner cylindrical member.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DESCRIPTION OF THE PREFERRED EMBODIMENTS

Figure 1:
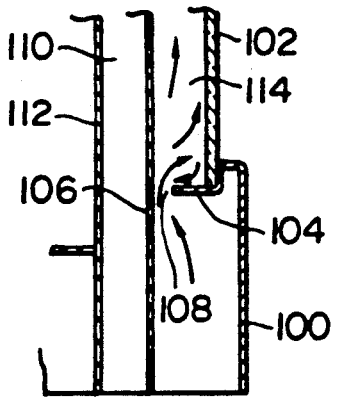
FIG. 1 PRIOR ART
FIG. 1 is a fragmentary vertical sectional view showing an essential part of a conventional combustion cylinder structure for an oil burner.

Now, a combustion cylinder structure for an oil burner according to the present invention will be described hereinafter with reference to FIGS. 2 to 5, wherein like reference numerals designate like or corresponding parts throughout.

Figure 2:
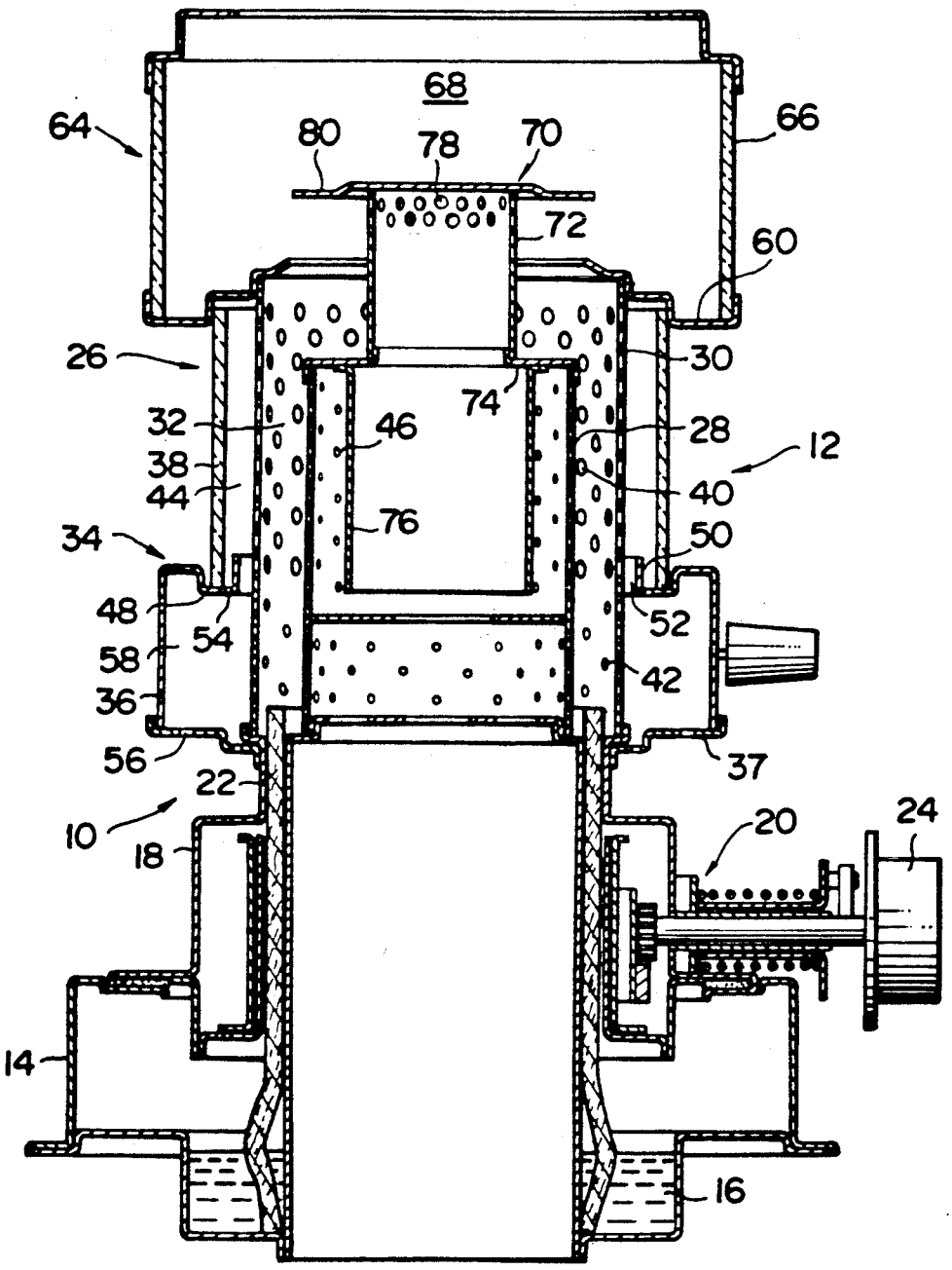
FIG. 2 is a vertical sectional view showing an example of an oil burner in which an embodiment of a combustion cylinder structure according to the present invention is adapted to be incorporated.

FIG. 2 shows an example of an oil burner in which an embodiment of a combustion cylinder structure according to the present invention is adapted to be incorporated, wherein an oil burner and a combustion cylinder structure of the embodiment are generally designated by reference numerals 10 and 12, respectively.

The oil burner 10 is exemplified in the form of a space heater. The oil burner 10 itself may be constructed in such a manner as known in the art. The oil burner 10 generally includes an oil reservoir 14 for storing therein fuel oil 16 such as kerosene and a wick receiving structure 18 arranged substantially on the oil reservoir 14 so as to communicate with the oil reservoir 14. In the wick receiving structure 18 is provided a wick moving mechanism 20 which is adapted to vertically move a wick 22 through the operation of a knob 24. For this purpose, the wick moving mechanism may be constructed in a manner widely known in the art, for example, as disclosed in U.S. Pat. No. 4,498,862 issued to Nakamura et al on Feb. 12, 1985.

Now, the combustion cylinder construction 12 of the illustrated embodiment will be described hereinafter with reference to FIGS. 2 and 3.

The combustion cylinder structure 12 is arranged on the wick receiving structure 18 and includes a multicylinder combustion means 26 including an inner cylindrical member 28 and an outer cylindrical member 30 which are arranged in a manner to define a first space 32 of an annular shape therebetween. Also, the multi-cylinder combustion means includes an outermost cylinder means 34 arranged outside the outer cylindrical member 30. The outermost cylinder means 34 comprises a heat-impermeable cylinder 36 arranged on a flange-like support 37 provided at the upper portion of the wick receiving structure 18 and a first heat-permeable cylinder 38 arranged on the heat-impermeable cylinder 36.

The outer cylindrical member 30 is formed with a plurality of through-holes comprising through-holes 40 of a larger diameter arranged at the upper and middle portions of the member 30 and through-holes 42 of a smaller diameter arranged at its lower portion. The heat-impermeable cylinder 36 is arranged so as to surround the lower portion of the outer cylindrical member and the heat-permeable cylinder 38 is arranged so as to surround the middle and upper portions of the cylinder 38 and define a second space 44 of an annular shape between the cylinder 38 and the outer cylindrical member 30. The inner cylindrical member 28 is formed with small through-holes 46.

The heat-impermeable cylinder 36 is provided with an inward collar 48 having a first portion extending toward the outer cylindrical member 30 in an inward direction therefrom. In the illustrated embodiment, the collar 48 is arranged at the upper end of the heat-impermeable cylinder 36 and the heat-permeable cylinder 38 is supported on the collar 48. Also, in the illustrated embodiment, the collar 48 may be positioned opposite to the boundary area between the lower portion of the outer cylindrical member 30 and its middle portion, i.e., the boundary area between through-holes 42 of smaller diameter and through-holes 40 of larger diameter. The collar 48 has a second portion which is upwardly bent at the distal end to the collar to form a vertical cylindrical section 50 of a suitable length which surrounds a part of the outer cylindrical member 30 through a suitable distance therebetween, resulting in an annular gap 52 being defined therebetween. As may be seen by referring to FIG. 2, the second portion of collar 48 extends upwardly from the boundary area of outer cylindrical member 30 to an area outside the boundary area, where the through-holes 40 of larger diameter are present. The collar 48 is formed at the portion thereof between the cylindrical section 50 and the heat-permeable cylinder 38 with a plurality of through-holes 54, which are preferably arranged in the circumferential direction of the collar at substantially equal intervals. In the combustion cylinder structure 12 constructed as described above, air supplied via through-holes 56 formed at the support 37 of the wick receiving structure 18 and the like into an annular space 58 space between the heat-impermeable cylinder 36 and the lower portion of the outer cylindrical member 30 is then supplied via the through-holes 54 of the collar 48 and the gap 52 into the second space 44 and rises as indicated by arrows in FIG. 3.

The outer cylindrical member 30 is provided on the upper end thereof with an annular top plate 60 in a manner to outward extend beyond the first heat-permeable cylinder 38. The inner end of the outer top plate 60 terminates substantially above the inner cylindrical member 28 in a manner to be upward spaced substantially from the inner cylindrical member 28. The first heat-permeable cylinder 38 is supported at the upper end thereof on the lower surface of the middle portion of the top plate 60.

The combustion cylinder structure 12 of the illustrated embodiment also includes a secondary combustion means 64, which includes a second heat-permeable cylinder 66 supported on the outer peripheral end of the outer top plate 60 and arranged so as to define a secondary combustion chamber 68 therein. In the combustion chamber 68 is arranged a flame spreading device 70, which includes a cylindrical member 72 supported on the inner end of an annular top plate 74 of the inner cylindrical member 28 so as to upward extend therefrom into the combustion chamber 68 and communicate with a central cylinder 76. The cylindrical member 72 is provided at the upper portion thereof with through-holes 78. The flame spreading device 70 also includes a flame spreading plate 80 arranged on the the upper end of the cylindrical member 72. The inner top plate 74 is provided so as to inward extend from the inner cylindrical member 28 and the central cylinder 76 is supported on the underside of the portion of the inner top plate 74 between inner cylindrical member 28 and the cylindrical member 72 of the flame spreading device 70 so as to downward extend therefrom. Also, the central cylinder 76 communicates with the interior of the oil burner 10 which communicates with an ambient atmosphere. The so-constructed flame spreading device 70 is adapted to carry out secondary combustion while forming a long white-yellow flame on the outside of the through-holes 78 of the cylindrical member 72 using combustible gas contained in combustion gas produced in the multi-cylinder combustion means 26 and air supplied thereto via the upper through-holes 40 of the outer cylindrical member 30 from the second space 44 and supplied thereto from the interior of the oil burner through the central cylinder 76 and the through-holes 78 of the cylindrical member 72.

The combustion cylinder structure of the illustrated embodiment constructed as described above carries out combustion of fuel oil in substantially the same manner as the conventional combustion cylinder structure. More particularly, in the combustion operation, fuel oil vaporized from the wick 22 is thermally decomposed and burned substantially in the first space 32 between the inner cylindrical member 28 and the outer cylindrical member 30 to red-heat both members and combustible gas remaining in combustion gas produced in the multi-cylinder combustion means 26 is subjected to complete combustion at the flame spreading device 70 in the secondary combustion chamber 68.

When the wick 22 is lowered through the knob 28 to reduce the amount of combustion in the combustion operation, the combustion is carried out substantially in the first space 32.

In the conventional combustion cylinder structure, as shown in FIG. 1 and described above, the collar 104 causes a part of combustion air supplied through the gap 108 to the second space 114 to whirl above the collar 104 as indicated by arrows in FIG. 1, leading to a turbulent flow, which cooperates with another part of the combustion air upwardly flowing in the second space 114 to spread or diffuse combustion gas produced on the outer surface of the outer cylindrical member 106 throughout the second space 114, so that the control of combustion in the combustion cylinder structure is restricted to a narrow range.

On the contrary, in the combustion cylinder structure of the illustrated embodiment, the collar 48 is upward bent at the distal end thereof to form the vertical cylindrical section 50, resulting in the gap 52 of a suitable vertical length being defined between the cylindrical section 50 and the outer cylindrical member 30, and the collar 48 is formed at the portion thereof between the cylindrical section 50 and the first heat-permeable cylinder 38 with the through-holes 54 in the circumferential direction for the passage of air. Such construction of the collar 48 permits air to upward flow through the gap 52 between the cylindrical section 50 and the outer cylindrical member 30 at an increased velocity while being guided by the cylindrical section 50, to thereby cause combustion gas produced on the outer surface of the outer cylindrical member 30 during the combustion operation to upward flow. Also, air flowing into a gap between the heat-permeable cylinder 38 and the cylindrical section 50 of the collar 48 via the through-holes 54 of the collar 48 likewise smoothly rises along the inner surface of the cylinder 38 without producing any turbulent flow, so that the diffusion of the above-described air flowing along the outer cylindrical member 30 into the air rising along the inner surface of the cylinder 38 may be substantially prevented.

Thus, in the illustrated embodiment, when the wick 22 is lowered for a small amount of combustion, this permits combustion on or near the outer surface of the outer cylindrical member 30 to be carried out using substantially all air supplied to the second space 44. Also, the combustion cylinder structure 12 permits the air rising along the first heat-permeable cylinder 38 to upward flow via the upper through-holes 40 of the outer cylindrical member 30 to the upper section of the structure 12 without substantially containing combustion gas produced on or near the outer cylindrical member 30. An experiment carried out by the inventors indicated that the conventional combustion cylinder structure in which the inner end of the collar 104 is positioned at substantially the center of the gap between the heat-permeable cylinder 102 and the outer cylindrical member 106 discharges carbon monoxide of 98 ppm in concentration when the wick is lowered to a level which causes combustion gas to contain 2.6% of carbon dioxide, whereas the combustion cylinder structure of the illustrated embodiment in which the collar 48 is provided at the inner end thereof with the cylindrical section 50 and formed with the through-holes 54 causes the concentration of carbon monoxide discharged when the wick 22 is lowered to the same level to be reduced to 52 ppm. Thus, it will be noted that the combustion cylinder structure of the embodiment improves the condition of combustion when the wick is lowered for a small amount of combustion.

As can be seen from the foregoing, the combustion cylinder structure of the illustrated embodiment is so constructed that the heat-impermeable cylinder of the outermost cylinder means is provided at the upper portion thereof with the collar inward extending toward the outer cylindrical member, which is upward bent at the distal end thereof to form the cylindrical section spaced at a substantially uniform distance from the outer cylindrical member and is provided with the through-holes. Such construction significantly improves the condition of combustion when the wick is lowered for a small amount of combustion. Thus, the embodiment permits the combustion operation to be positively controlled over a wide range because it can effectively decrease the combustion to a low level which, in the conventional combustion cylinder structure, causes the red-heating of the inner and outer cylindrical members to be highly deteriorated.

Figure 4:
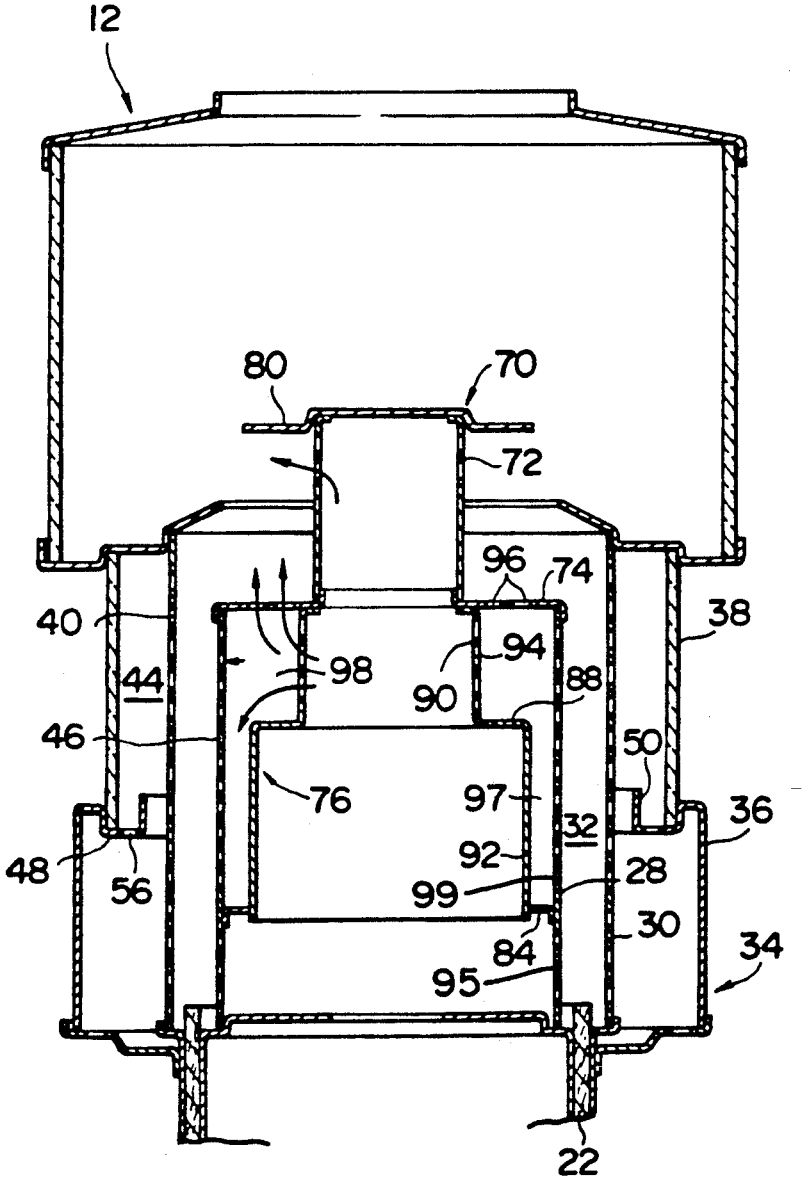
FIG. 4 is an enlarged vertical sectional view showing a modification of the combustion cylinder structure shown in FIG. 1.

FIG. 4 shows a modification of the embodiment described above, which is adapted to effectively prevent incomplete combustion over a wide combustion range.

A combustion cylinder structure of the modification which is generally indicated at reference numeral 12 in FIG. 4 includes a central cylinder 76 suspended from a top plate 74 of an inner cylindrical member 28 so that it is arranged inside the inner cylindrical member 28 in a manner to positionally correspond to the red-heating section of the inner cylindrical member 28.

Also, the combustion cylinder structure 12 of the modification includes a partition plate 84 of a substantially annular shape arranged in a gap 86 defined between the lower portion of the inner cylindrical member 28 and the lower end of the central cylinder 76. In the modification, the partition plate 84 is mounted on the inner periphery of the inner cylindrical member 28 in a manner to extend toward the central cylinder 76. Also, in the modification, it is possible to substantially prevent the introduction of air from the interior of an oil burner through the gap 86 into a space between the inner cylindrical member 28 and the central cylinder 76. For this purpose, the distal end of the partition plate 84 may extend so as to terminate on the central cylinder 76. In this instance, the partition plate may be provided on the central cylinder so that it may be formed together with the central cylinder and a cylindrical member 72 of a flame spreading device 70, to thereby facilitate the manufacturing of the combustion cylinder structure 12. Alternatively, the modification may be constructed so as to introduce a slight amount of air through the gap 86.

Further, the central cylinder 76 may be provided at the upper portion thereof with a step 88 of an annular shape, through which the cylinder 76 is divided into two sections comprising an upper section 90 of a small diameter and a lower section 92 of a large diameter. The step 88 is preferably formed at substantially the same level as the upper end of a small flame produced when a wick 22 is lowered for a minimum amount of combustion. The arrangement of the step 88 causes a space 97 defined between the lower section 92 of the central cylinder 76 and the inner cylindrical member 28 to be narrowed as compared with a space 98 between the upper section 90 and the member 28. The upper section 90 of the central cylinder 76 is provided with a plurality of through-holes 94. Likewise, the inner top plate 74 is provided with through-holes 96. The through-holes are preferably arranged at the portion of the top plate 74 positioned above the step 88. This permits air rectified via the through-holes 94 of the upper section 90 of the central cylinder 76 to effectively rise via the through-holes 96 toward the flame spreading device 70.

Figure 3:
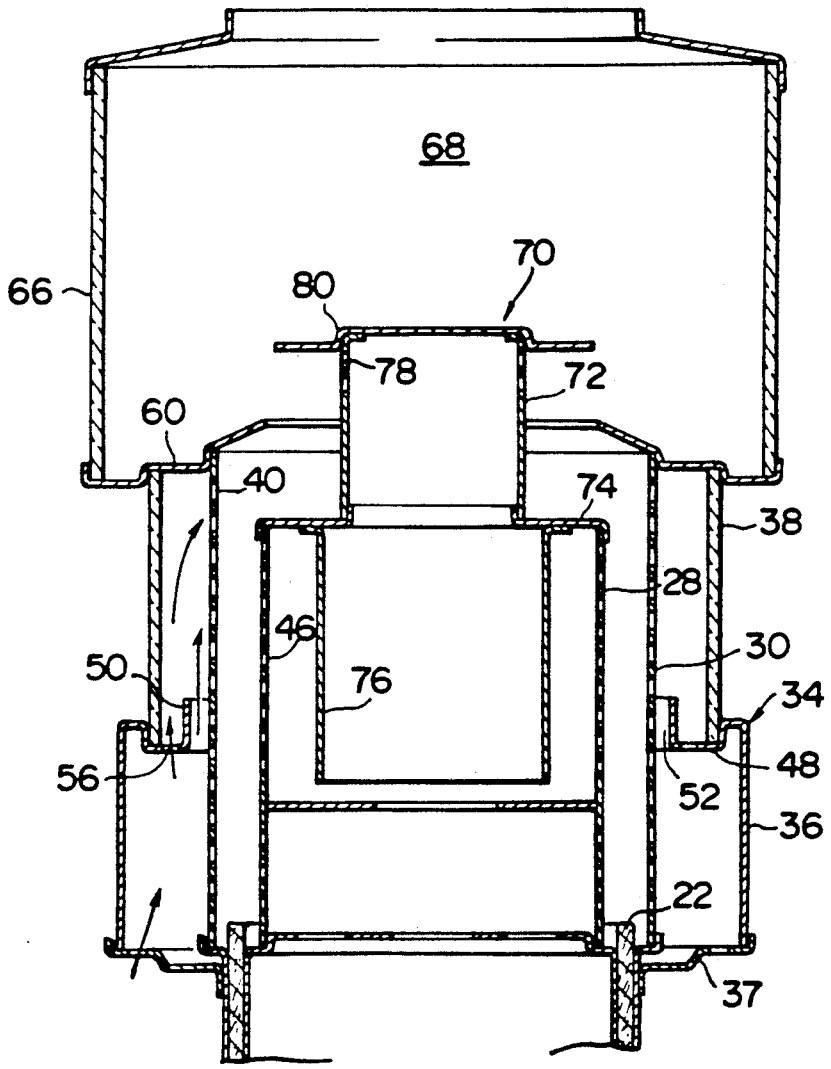
FIG. 3 is an enlarged vertical sectional view showing the combustion cylinder structure shown in FIG. 2.

The remaining part of the modification shown in FIG. 4 may be constructed in substantially the same manner as the embodiment shown in FIGS. 2 and 3.

The manner of operation of the modification will be described hereinafter.

The combustion operation is carried out in substantially the same manner as the above-described embodiment. More particularly, fuel oil vaporized from a wick 22 is subjected to thermal decomposition and partially burned in a first space 32 between the inner cylindrical member 28 and an outer cylindrical member 30 to produce rising combustion gas. Combustible gas contained in the combustion gas such as hydrocarbon, carbon monoxide and the like is subjected to complete combustion at the flame spreading device 70. In the modification, a sufficient amount of combustion air is supplied to the outside of the flame spreading device 70 as well as the inside of the device 70 through the interior of the central cylinder 76, because a negative pressure is generated due to the combustion in the combustion cylinder structure 12 and the upper portion of the central cylinder 76 and the top plate 74 of the inner cylindrical member 28 are formed with the through-holes 94 and 96, respectively. Thus, satisfactory complete combustion takes place at the flame spreading device 70 without generating any soot even when a large amount of combustion is carried out at the combustion cylinder structure. When the through-holes 96 are formed at the portion of the top plate 74 positioned above the step 88, the supply of air to the outside of the flame spreading device 70 is more effectively carried out.

In the modification, the partition plate 84 is arranged between the lower end of the central cylinder 76 and the lower portion of the inner cylindrical member 28 to substantially close the gap therebetween, to thereby restrict the introduction of air therefrom. Accordingly, the supply of combustion air to the first space 32 is carried out from the through-holes 94 of the central cylinder 94 via the through-holes 46 of the inner cylindrical member 28 due to the drafting action of a flame produced in the first space 32. This causes the inner cylindrical member 28 to be satisfactorily red-heated to a degree enough to emit sufficient heat rays from the inner cylindrical member 28 as well as the outer cylindrical member 30.

Further, when the wick 22 is lowered for a small amount of combustion, the combustion is carried out only in the first space 32, particularly, the lower portion of the space. In this instance, air required for the combustion is likewise supplied via the lower through-holes 95 of the inner cylindrical member 28 to the lower portion of the first space 32 due to the drafting action of a small flame produced in the lower portion of the first space 32. The arrangement of the step 88 at the central cylinder 76 for narrowing the lower space 97 between the lower section 92 of the central cylinder 76 and the inner cylindrical member 28 as compared with the upper space 98 between the upper section 90 and the member 28 further facilitates the introduction of the air into the first space 32, because the drafting action of the flame more affects the lower narrow space 97 to produce a higher negative pressure therein. Accordingly, the step 88 is preferably provided at substantially the same level as the upper end of a small flame produced in the first space 32 when the wick is lowered for a minimum amount of combustion. Further, when the partition plate 84 is arranged so as to permit a slight amount of air to be introduced through the gap between the lower end of the central cylinder 76 and the inner cylindrical member 28 into the space 97, combustion in the first space 32 when the wick 22 is lowered is more stably carried out, because the air is supplied via intermediate through-holes 99 of the inner cylindrical member 28 to the lower portion of the space 32.

Accordingly, although the lowering of the wick causes a large amount of air to flow via the through-holes 4 of the upper section 90 of the central cylinder 76 to the upper section of the combustion cylinder structure 12. it is effectively prevented that the air affects the supply of combustion air to the lower portion of the first space 32 for a small amount of combustion.

Thus, it will be noted that the modification permits the combustion of fuel oil in the first space 32 to be stably and safely carried out over a wide range. An experiment by the inventors indicated that the combustion cylinder structure meets the exhaust gas requirements defined in JIS (the Japanese Industrial Standards), even when the combustion is decreased to a level of about 40% of the maximum combustion.

Also, in the modification, the partition plate, central cylinder and cylindrical member 72 may be integrally formed, resulting in the manufacturing of the combustion cylinder structure being highly facilitated.

Figure 5:
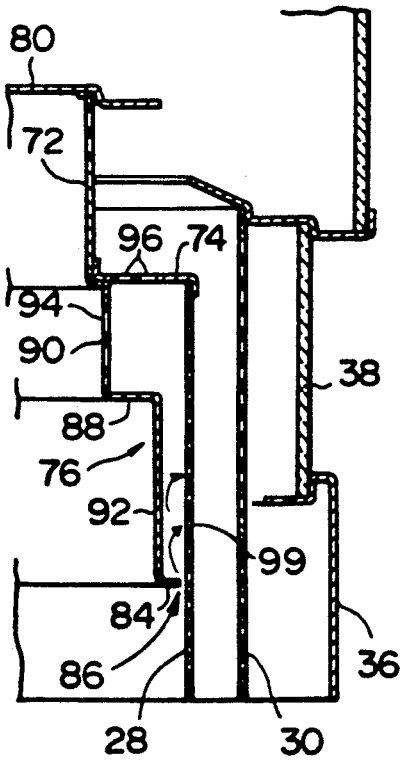
FIG. 5 is a fragmentary vertical sectional view showing an essential part of another modification of the combustion cylinder structure shown in FIG. 1.

FIG. 5 shows another modification of the embodiment shown in FIGS. 2 and 3. In a combustion cylinder structure 12 shown in FIG. 5, a partition plate 84 is formed integral with the lower end of a central cylinder 76 so as to extend toward an inner cylindrical member 28. In the modification, the outer end of the partition plate 84 terminates at a position slightly inwardly spaced from the inner cylindrical member 28. The remaining part of the modification may be constructed in substantially the same manner as the modification shown in FIG. 4.

Thus, it will be noted that the modification of FIG. 5 accomplishes substantially the same advantages as the modification shown in FIG. 4.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A combustion cylinder structure for an oil burner comprising:

a multi-cylindrical combustion means including a perforated inner cylindrical member, an outer cylindrical member arranged outside said inner cylindrical member and an outermost cylinder arranged outside said outer cylindrical member, said outer cylindrical member being formed at the lower portion thereof with a plurality of through-holes of a smaller diameter and at the middle and upper portions thereof with a plurality of through-holes of a larger diameter, said outermost cylinder including a heat-impermeable cylinder arranged so as to surround said lower portion of said outer cylinder member and to heat-permeable cylinder arranged on said heat-impermeable cylinder so as to surround said middle and upper portions of said outer cylindrical member; and, a collar provided at the upper portion of said heat-impermeable cylinder with a first collar portion which extends inwardly from said heat-impermeable cylinder toward an area of said outer cylindrical member which is a boundary area between said through-holes of smaller diameter and said through-holes of larger diameter, said heat-permeable cylinder being put on said collar, said collar having a second collar portion which is bent upwardly at the distal end of the collar to form a cylindrical section which is spaced from said outer cylindrical member to define a vertically extending gap of substantially uniform width between said second collar portion and said outer cylindrical member, said second collar portion extending upwardly opposite to said boundary area of said outer cylindrical member, said first collar portion being formed with through-holes, and said second collar portion extending upwardly for a distance sufficient to prevent turbulent flow between said outer cylindrical member and said heat-permeable cylinder by causing smooth upward flow of air flowing through said vertically extending gap and of air flowing through the through-holes of said first collar portion during a small amount of combustion in said oil burner.

2. A combustion cylinder structure as defined in claim 1, wherein said through-holes of said collar are circumferentially arranged.

3. A combustion cylinder structure as defined in claim 2, wherein said through-holes of said collar are arranged at substantially equal intervals.

4. A combustion cylinder structure as defined in claim 1 wherein said second collar portion extends upwardly above the level of said boundary area in opposing relation to a portion of the larger diameter through-holes of said outer cylindrical member.

5. A combustion cylinder structure as defined in claim 1 further comprising:

a central cylindrical arranged in said inner cylindrical member in a manner to be suspended from an annular top plate of said inner cylindrical member and positioned opposite to a section of said inner cylindrical member which becomes red-heated during operation, said central cylindrical being formed at an upper portion thereof with through-holes;

a partition plate arranged between a lower end of said central cylinder and said inner cylindrical member so as to restrict the introduction of air between said lower end of said central cylinder and said inner cylindrical member into a space therebetween; and, a flame spreading device including a flame spreading cylinder communicating through said top plate with said central cylinder, said top plate of said inner cylindrical member being formed with through-holes.

6. A combustion cylinder structure as defined in claim 5, wherein said central cylinder is formed with a step which divides said central cylinder into an upper section of a smaller diameter and a lower section of a larger diameter.

7. A combustion cylinder structure as defined in claim 6, wherein said step is arranged at substantially the same level as the upper end of a flame produced when a wick is lowered for a minimum amount of combustion.

8. A combustion cylinder structure as defined in claim 6, wherein said through-holes of said top plate are formed at the portion of said top plate positioned above said step.

9. A combustion cylinder structure as defined in claim 5, wherein said partition plate is arranged to prevent air from being introduced into said space between said central cylinder and said inner cylindrical member.

10. A combustion cylinder structure as defined in claim 6, wherein said partition plate is arranged to provide a gap permitting a slight amount of air to be introduced through said gap into said space between said central cylinder and said inner cylindrical member.

* * * * *

UNITED STATES PATENT AND TRADEMARK OFFICE

CERTIFICATE OF CORRECTION

PATENT NO. : 5,087,195

DATED : February 11, 1992

INVENTOR(S) : Nakanishi, et al.

It is certified that error appears in the above-identified patent and that said Letters Patent is hereby corrected as shown below:

Column 11, line 48, change "to" to --a--.

Column 12, line 27, change "cylindrical" to --cylinder--.

Column 12, line 33- change "cylindrical" to --cylinder--.

Signed and Sealed this

Fourth Day of May, 1993

*Attest:*

Michael K. Kirk

MICHAEL K. KIRK

*Attesting Officer*

*Acting Commissioner of Patents and Trademarks*